US007802778B2

(12) United States Patent
Kurita

(10) Patent No.: US 7,802,778 B2
(45) Date of Patent: Sep. 28, 2010

(54) PAPER FOLDING APPARATUS

(75) Inventor: Wataru Kurita, Saitama (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 11/966,163

(22) Filed: Dec. 28, 2007

(65) Prior Publication Data

US 2008/0174061 A1 Jul. 24, 2008

(30) Foreign Application Priority Data

Jan. 9, 2007 (JP) ..... 2007-001476

(51) Int. Cl.
*B41L 43/00* (2006.01)
*B41L 1/32* (2006.01)
*B42C 1/00* (2006.01)

(52) U.S. Cl. ..... 270/39.01; 270/32; 270/39.06; 270/39.08; 270/45

(58) Field of Classification Search ..... 270/32, 270/39.01, 39.06, 39.08, 45
See application file for complete search history.

(56) References Cited

U.S. PATENT DOCUMENTS 6,024,682 A * 2/2000 Mandel et al. ..... 493/23

FOREIGN PATENT DOCUMENTS

| | | | |
|---|---|---|---|
| JP | 5-238635 | | 9/1993 |
| JP | 05238635 | A * | 9/1993 |
| JP | 11-349218 | | 12/1999 |
| JP | 11349218 | A * | 12/1999 |
| JP | 2004-67266 | | 3/2004 |
| JP | 2004067266 | A * | 3/2004 |
| JP | 2006-335500 | | 12/2006 |
| JP | 2006335500 | A * | 12/2006 |

* cited by examiner

*Primary Examiner*—Gene Crawford
*Assistant Examiner*—Yolanda Cumbess
(74) *Attorney, Agent, or Firm*—Oblon, Spivak, McClelland, Maier & Neustadt, L.L.P.

(57) ABSTRACT

An accordion folding mechanism folds a sheet fed from an image forming apparatus in an accordion shape by repeating a mountain fold and a valley fold in a direction perpendicular to a sheet conveying direction. A size setting unit sets a folding size of the mountain fold and the valley fold. A size adjusting unit compares a size of the sheet fed from the image forming apparatus with the folding size, and adjusts the folding size of a predetermined number of folds at a trailing end of the sheet.

11 Claims, 13 Drawing Sheets

PAPER FOLDING APPARATUS

CROSS-REFERENCE TO RELATED APPLICATIONS

The present application claims priority to and incorporates by reference the entire contents of Japanese priority document 2007-001476 filed in Japan on Jan. 9, 2007.

BACKGROUND OF THE INVENTION

1. Field of the Invention

The present invention relates to a paper folding apparatus that folds a large sheet in a bellows shape. The paper folding apparatus is connected to a printer, a copying machine, or a fax machine and used as a folder, a finisher, or a connection assembly having a paper folding function, or used as a single folder or a finisher having a paper folding function.

2. Description of the Related Technology

Generally, when an electronic copying machine capable of copying on large sheets such as A0 and A1 is used, if these large sheets are directly stored or handled, a storage space becomes large and handling thereof is inconvenient. Therefore, large sheets are generally folded to be stored or handled. However, if the sheet folding operation is manually performed, a considerably long time is required, and the time required for folding the sheet can be longer than the time required for copying.

Therefore, there is a system in which a paper folding device capable of automatically folding the sheet is arranged in a sheet ejection route of the copying machine, so that the copied large sheet can be automatically folded continuously. In the paper folding device used in such a system, some devices also have a unit not only for automatically folding the sheet ejected from the copying machine (online operation) but also for folding a sheet already copied and ejected without being folded and a large sheet generated by another image forming apparatus (offline operation).

When folding is actually performed by such a system, in the case of regular paper such as A0 and A1, a predetermined size can be used to perform folding as the size for each fold of the sheet to be folded. However, in the electronic copying machine capable of copying on a large sheet, copy can be made on a long sheet having a sub scanning length of several meters, and folding is required for such an irregular long sheet.

A paper folding apparatus described in Japanese Patent Application Laid-open No. H5-238635 folds sheets other than the regular sheets into a specified size by automatically adjusting a folding length of each folding section. Japanese Patent Application Laid-open No. H11-349218 discloses a folding method and a mechanism for forming folds in good order in a desired folding mode, and Japanese Patent Application Laid-open No. 2004-67266 discloses a paper folding device that prevents an unnecessary fold from being formed when a folded sheet is ejected. Japanese Patent Application Laid-open No. 2006-335500, which is proposed by the present inventor, discloses a paper folding apparatus that reduces a difference in the folding size even when a large sheet with the end thereof is curled.

When the regular sheet is folded, the sheet can be folded in a specified finished size by folding the sheet with a predetermined length. In the case of the irregular sheet, the sheet can protrude from the specified finished size. However, even if it is tried to fold the sheet without the protruded portion, the sheet cannot be folded in a short width of from 2 to 30 millimeters (mm) smaller than a minimum folding width, due to a mechanical restriction of the paper folding apparatus (foldable minimum folding width). Even if there is no protruded portion, the number of folds becomes an odd or even number, and therefore the finished state varies according to the size of the original sheet.

Generally, it is preferable that the sheet is folded in a specified finished size (in most cases, A4), and the folded sheet with the protruded portion is not desirable. Further, an original large sheet to be copied and folded is a drawing in most cases, it is desired that the sheet is folded with a title block being on an outside. The title block of the drawing is normally on a right bottom position when the sheet is placed sideways. As shown in FIG. 9A, when the sheet is folded from the left side, designating the first fold as the mountain fold, if the number of folds is an even number, the title block is on the outside (FIG. 9B). However, when the number is an odd number, the title block is on an inside (FIG. 9C), which is not desirable. That is, it is desired to set the upside of the last fold as the outside of the sheet.

To avoid these problems, as one method, in a system having an electronic copying machine capable of cutting a rolled sheet in an arbitrary length and copying on the sheet, the sheet length is appropriately adjusted to a cut length of the rolled sheet set according to a folding condition, so that there is no protruded portion or folding is finished always with even number of folds.

The paper folding apparatus described in Japanese Patent Application Laid-open No. H5-238635 proposes a method in which a detected length of the sheet to be folded is compared with a standard sheet length for each folding pattern to obtain correction data, and the folding size of a certain fold to be folded is corrected according to the correction data, so that even a sheet having an irregular size can be folded in a specified finished size.

By using such methods, even in the case of the irregular sheet, the finished size is always uniform. However, in the case of the method in which the cut length of the rolled sheet is adjusted, a sheet having an unintended copy size is output, and a portion where the length is adjusted becomes a blank space, which is not the original image, thereby making the copy unnatural. Further, the effect cannot be obtained with respect to an irregular sheet output by another system.

In the paper folding apparatus described in Japanese Patent Application Laid-open No. H5-238635, the correction data is obtained by comparing a standard sheet length, which is a regular sheet size, with a detected running sheet length, which is an irregular sheet size to be actually folded, is added to a corrected part, which is the fold to be corrected, so that a specified finished size is obtained. However, when the correction data is for a size equal to or smaller than the standard size of the corrected part, or when the size obtained by adding the correction data to the standard size of the corrected part protrudes from the finished size, the same effect cannot be demonstrated evenly with respect to all sizes of irregular sheet.

SUMMARY OF THE INVENTION

It is an object of the present invention to at least partially solve the problems in the conventional technology.

A paper folding apparatus according to one aspect of the present invention includes an accordion folding mechanism that folds a sheet fed from an image forming apparatus in an accordion shape by repeating a mountain fold and a valley fold in a direction perpendicular to a sheet conveying direction; a size setting unit that sets a folding size of the mountain fold and the valley fold; and a size adjusting unit that compares a size of the sheet fed from the image forming apparatus with the folding size, and adjusts the folding size of a predetermined number of folds at a trailing end of the sheet.

A paper folding apparatus according to another aspect of the present invention includes an accordion folding mechanism that folds a sheet fed from an image forming apparatus in an accordion shape by repeating a mountain fold and a valley fold in a direction perpendicular to a sheet conveying direction; a size setting unit that sets a folding size of the mountain fold and the valley fold; a measuring unit that measures a remaining sheet length that is remained unfolded; and a size adjusting unit that compares the remaining sheet length with the folding size, and adjusts the folding size of a predetermined number of folds at a trailing end of the sheet.

A paper folding apparatus according to still another aspect of the present invention includes an accordion folding mechanism that folds a sheet fed from an image forming apparatus in an accordion shape by repeating a mountain fold and a valley fold in a direction perpendicular to a sheet conveying direction; a mountain-fold/valley-fold setting unit that sets either one of the mountain fold and the valley fold for a first fold; a size setting unit that sets a folding size of the mountain fold and the valley fold; and a size adjusting unit that compares the sheet size with the folding size, calculates number of folds for folding the sheet size with the folding size and a folding width of a last fold, when the mountain fold is set by the mountain-fold/valley-fold setting unit and when the number of folds is an odd number, changes the odd number to an even number, when the valley fold is set by the mountain-fold/valley-fold setting unit and when the number of folds is an even number, changes the even number to an odd number, and adjusts the folding size of a predetermined number of folds at a trailing end of the sheet, so that a width of the last fold becomes equal to or larger than a predetermined minimum folding width and equal to or smaller than the folding size.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 9A depicts the sheet before folding, FIG. 9B depicts a mountain-folded sheet, and FIG. 9C depicts a valley-folded sheet;

FIG. 10A depicts a mode in which a folding remainder (30 millimeters) of a folding size Lx is shorter than a minimum folding width (70 millimeters), thereby requiring folding adjustment, FIG. 10B depicts a mode of the folding adjustment applied to a case of the mode (a), and FIG. 10C depicts another mode of the folding adjustment;

DETAILED DESCRIPTION OF THE PREFERRED EMBODIMENTS

Exemplary embodiments of the present invention are explained in detail below with reference to the accompanying drawings.

Figure 1:
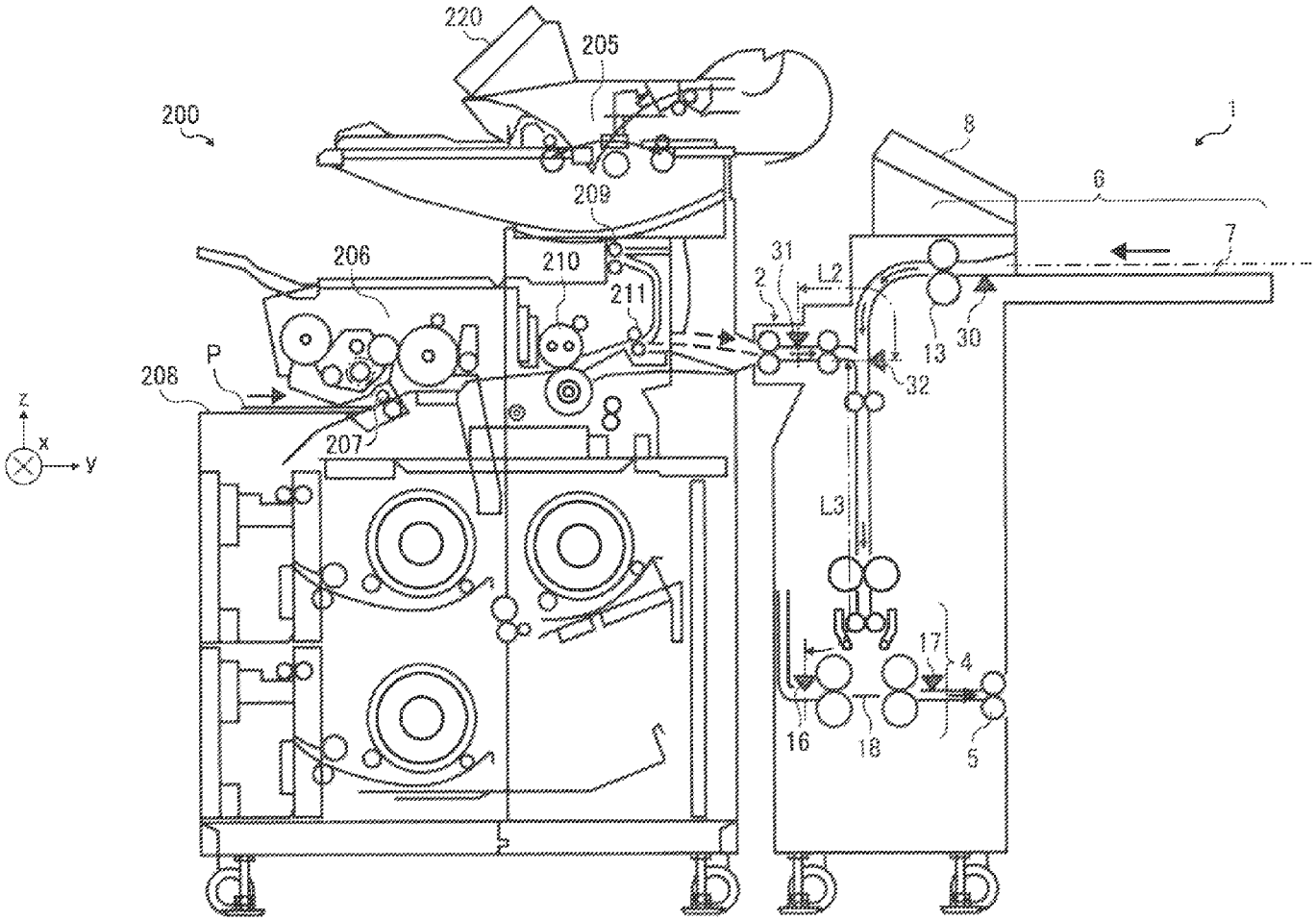
FIG. 1 is a longitudinal sectional view of an outline of a mechanism of a paper folding apparatus according to a first embodiment of the present invention and a copying machine connected with the paper folding apparatus.

FIG. 1 is a schematic diagram of a paper folding apparatus 1 according to a first embodiment of the present invention, which is connected to a copying machine 200. The paper folding apparatus 1 includes a connecting part 2 having a first sheet insertion port to which a sheet having an image transferred thereon by the copying machine 200 is fed, and an accordion folding mechanism 4 that folds the sheet in a bellows shape in a transport direction. The paper folding apparatus 1 further includes a manual feed table 7 that supports the sheet inserted into a manual-feed sheet-insertion port, which is a second sheet insertion port, and a manual-feed sheet carrier unit that carries the sheet inserted into the manual-feed sheet-insertion port to the accordion folding mechanism 4, so that the sheet can be inserted without via the copying machine 200, that is, offline.

The copying machine 200 feeds the sheet on which an image has been copied to the connecting part 2, with an image being upward. When the sheet reaches the accordion folding mechanism 4, the image is rightward in FIG. 1. Further, regarding the sheet inserted into the manual-feed sheet-insertion port of the paper folding apparatus 1 (for example, drawing sheet), the sheet is inserted into the manual-feed sheet-insertion port with the image (drawing) being downward, so that when the sheet reaches the accordion folding mechanism 4, the image (drawing) is rightward in FIG. 1.

An online operation for carrying and folding the sheet, onto which an image is transferred by the copying machine 200, is performed based on a user input for copying and automatic folding with respect to an operation display board 220 provided in the copying machine 200. An offline operation for feeding the sheet placed on a manual feed unit 6 of the paper folding apparatus 1, that is, manual feed sheet to the accordion folding mechanism 4 is performed based on a user input for automatic folding with respect to an operation display board 8 provided on the paper folding apparatus 1.

A user sets the sheet size and folding type on the operation display board 220 of the copying machine 200. The copying machine 200 includes an image reader 205, and a manual feed table 208 below thereof. Large roll paper suitable for making a large copy and a roll-paper feed unit that feeds the roll paper are provided below the manual feed table 208.

When the sheet is set on the manual feed table 208 and fed or the roll paper (sheet) is fed from the roll-paper feed unit, the sheet is temporarily stopped at the position of a registration roller 207, and supplied to an imaging unit, with the timing matched with an image forming operation of an imaging unit 206. The imaging unit 206 forms a latent image corresponding to image data on a photoconductor (not shown), and develops the latent image with a toner to form a toner image. The toner image is transferred to the sheet, and joined and secured, that is, fixed on the sheet by a fuser 210. The sheet on which the toner is fixed, that is, recorded sheet is fed to the connecting part 2 by an ejection roller 211 in the case of performing folding, or to an upper paper ejection roller 209 by a switching claw (not shown) and fed to a storage space in a body, in the case of not performing folding.

The recorded sheet ejected from the copying machine 200 is fed to the paper folding apparatus 1 and passes through the connecting part 2. At this time, the paper folding apparatus 1 recognizes that the sheet is inserted into the paper folding apparatus 1 by a sheet-insertion detection sensor 31. The sheet-insertion detection sensor 31 is used for recognizing that the sheet is inserted from the copying machine 200, as well as for detecting a rear end of the sheet. The sheet-insertion detection sensor 31 is also used for measuring a sub scanning length of the sheet based on the time from insertion of the sheet to detection of the rear end. The sheet having passed through the connecting part 2 is fed to the accordion folding mechanism 4 positioned below the paper folding apparatus 1 along a carrier route, and folded alternately in a direction y orthogonal to a transport direction z repeatedly. Accordingly, the sheet folded in a bellows shape is discharged to the outside by an ejection roller 5.

When the user places a sheet to be folded on the manual feed table 7 and inserts the sheet in a direction of arrow in FIG. 1 (direction opposite to the direction y), a manual-feed-insertion detection sensor 30 detects the sheet. A pair of manual-feed carrier rollers 13 is rotated at predetermined timing based on the detection of the sheet to hold a sheet of paper P (hereinafter, "sheet P") and temporarily stopped. The manual-feed-insertion detection sensor 30 can be used for detecting the rear end of the sheet inserted from the manual feed table and measuring the sub scanning length of the sheet, as with the sheet-insertion detection sensor 31.

The user then performs setting required for the operation such as folding type on the operation display board 8 provided on the paper folding apparatus 1, and presses a start button. The pair of manual-feed carrier rollers 13 then rotates again, to carry the sheet in the direction of arrow to the accordion folding mechanism 4 below the paper folding apparatus 1 along the carrier route. The operation thereafter is the same as that in the case of the online automatic folding.

A sheet-length detection sensor 32 is arranged slightly on a downstream side of a route where the carrier route of the sheet inserted into the paper folding apparatus 1 online and the carrier route of the sheet inserted offline join together, to measure the sub scanning length of the sheet both online and offline.

Figure 2:
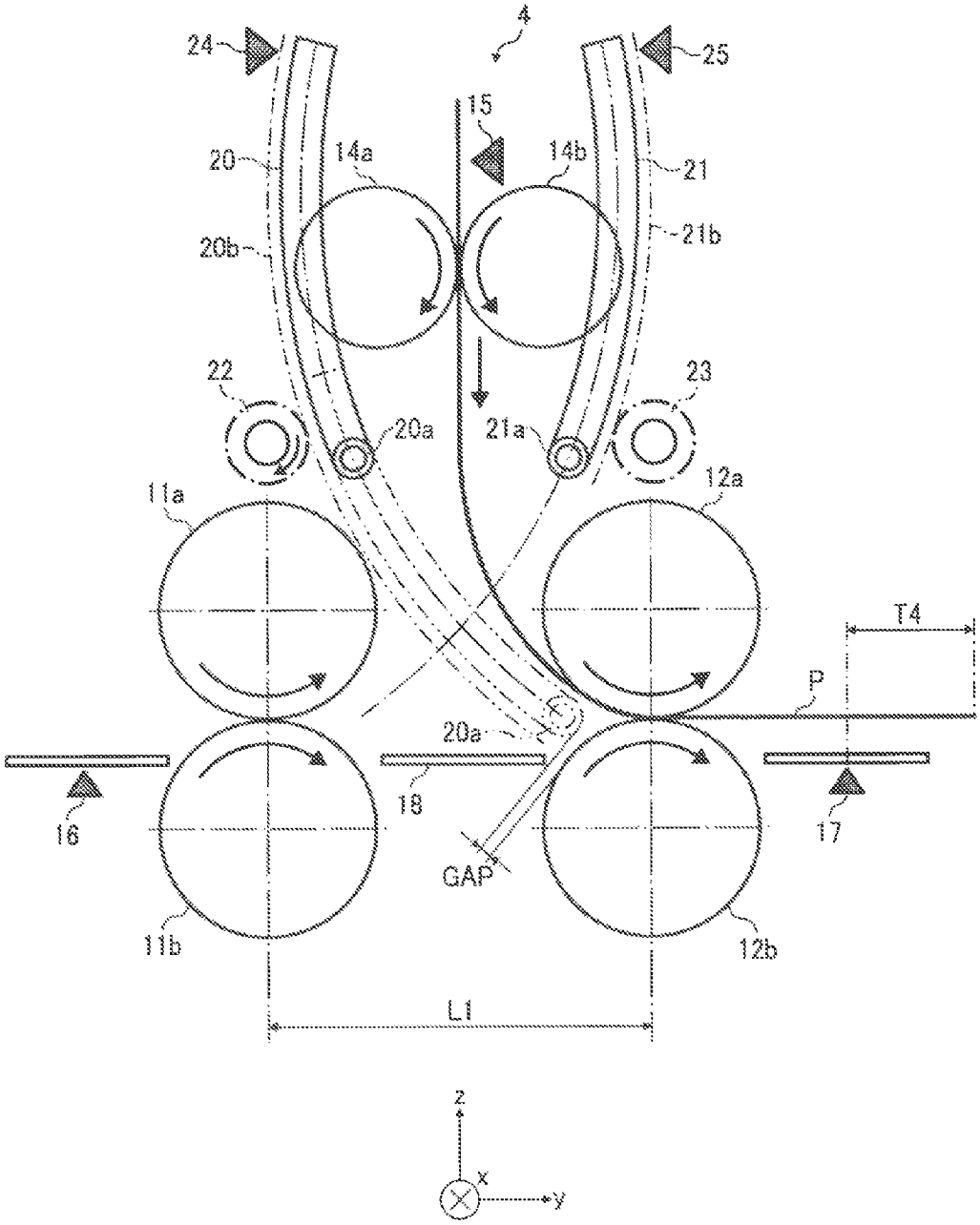
FIG. 2 is an enlarged side view of relevant parts of an accordion folding mechanism shown in FIG. 1, in which a standby condition of a right deflection guide is shown by a solid line and a paper-feed guiding condition thereof is shown by a two-dot chain line.

FIG. 2 is an enlarged view of the accordion folding mechanism 4 shown in FIG. 1. In FIG. 2, a front-end detection sensor 15 that detects a front end of the sheet is provided at an entrance of the accordion folding mechanism 4, and a pair of carrier rollers 14 is arranged on the downstream side thereof. Pairs of folding rollers 11 and 12 are arranged on the downstream side thereof. The pairs of folding rollers 11 and 12 are positioned right and left of the transport line (downward opposite to the direction z) of the pair of carrier rollers 14 to rotate normally and reversely synchronously, thereby folding the sheet in the bellows shape in a horizontal direction y. A left-folding-width detection sensor 16 and a right-folding-width detection sensor 17 are respectively arranged outside of the pairs of folding rollers 11 and 12, to detect the sheet. A lower guide plate 18 is provided between the pairs of folding rollers 11 and 12, to guide the end face of the folded sheet to the pairs of folding rollers 11 and 12. The pair of carrier rollers 14 is rotated by a carrier motor via a gear and a drive belt (not shown). The pairs of folding rollers 11 and 12 are also rotated by a folding motor via a gear and a drive belt (both not shown).

Figure 4:
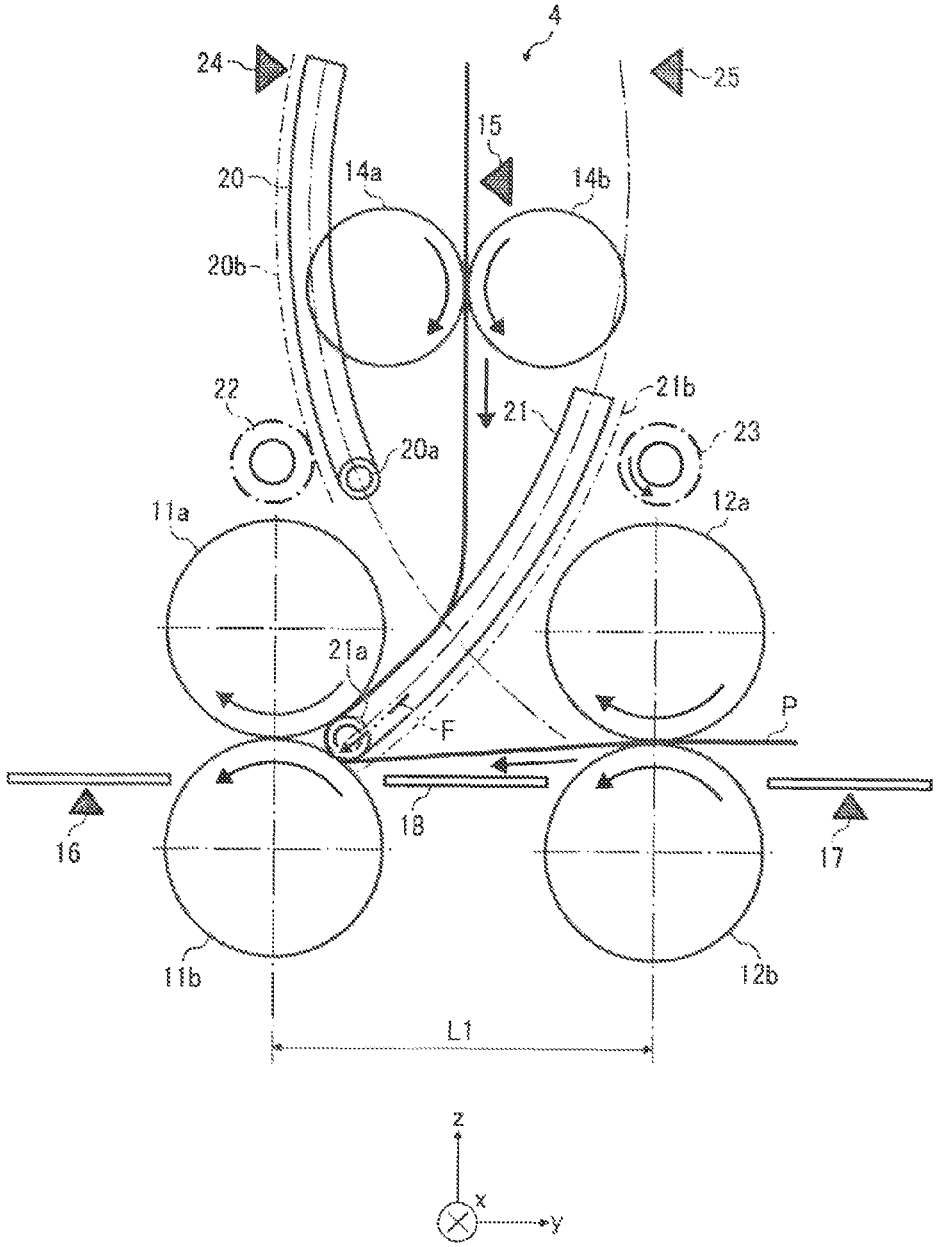
FIG. 4 is an enlarged side view of the relevant parts of the accordion folding mechanism shown in FIG. 1, depicting a state in which the left deflection guide has reached a position for feeding the sheet to the roller pair.

The accordion folding mechanism 4 includes deflection guides 20 and 21 for switching guide of the front end of the sheet to the pair of folding rollers 11 or 12. The deflection guides 20 and 21 are respectively in a circular-arc shape for guiding the sheet to the lower folding rollers 11*b* and 12*b*, and are supported by a guide mechanism (not shown) to move in circular-arc tracks, and driven to rotate by drive gears 22 and 23. The front end of the sheet is guided to one of the pair of folding rollers 11 or 12 by the deflection guide 20 or 21, and enters into a nip between the pair of folding rollers. The deflection guide 20 for guiding the sheet to the right pair of folding rollers 12 is referred to as a right deflection guide, and the deflection guide 21 for guiding the sheet to the left pair of folding rollers 11 is referred to as a left deflection guide. When the sheet is to be folded back, for example, as shown in FIG. 4, the deflection guide 20 or 21 guides the inside of the sheet to the nip of the pairs of folding rollers 11 or 12. At this time, rollers 20*a* and 21*a* mounted at the end of the deflection guides 20 and 21 respectively abut against the lower folding rollers 11*b* and 12*b*. A douser (not shown) is provided at the end of the left deflection guide 21, so that a left deflection-guide HP censor 25 is shaded at a position where the left deflection guide 21 is standing by for going up, thereby detecting a standby position. The left deflection guide 21 is rotated by a left deflection-guide drive motor (not shown) via a drive gear 23. The right deflection guide 20 has the same configuration.

Figure 7:
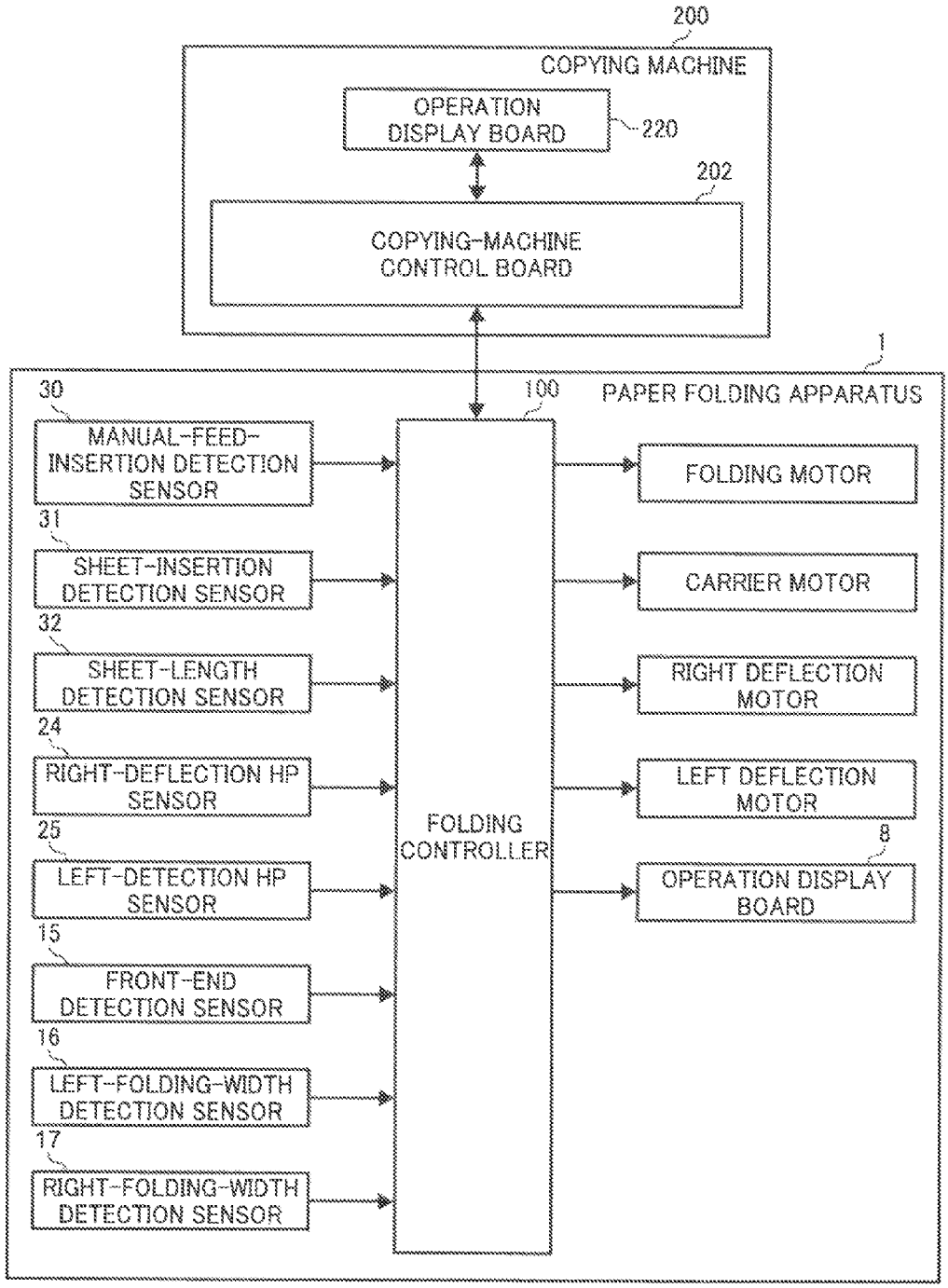
FIG. 7 is a block diagram of a configuration associated with paper folding of the paper folding apparatus shown in FIG. 1.

A left deflection motor and a right deflection motor for rotating the gears 22 and 23, and HP sensors 24 and 25 are connected, as shown in FIG. 7, to a folding controller 100, which monitors the state of each sensor and drives each motor with the timing adjusted.

Figure 3:
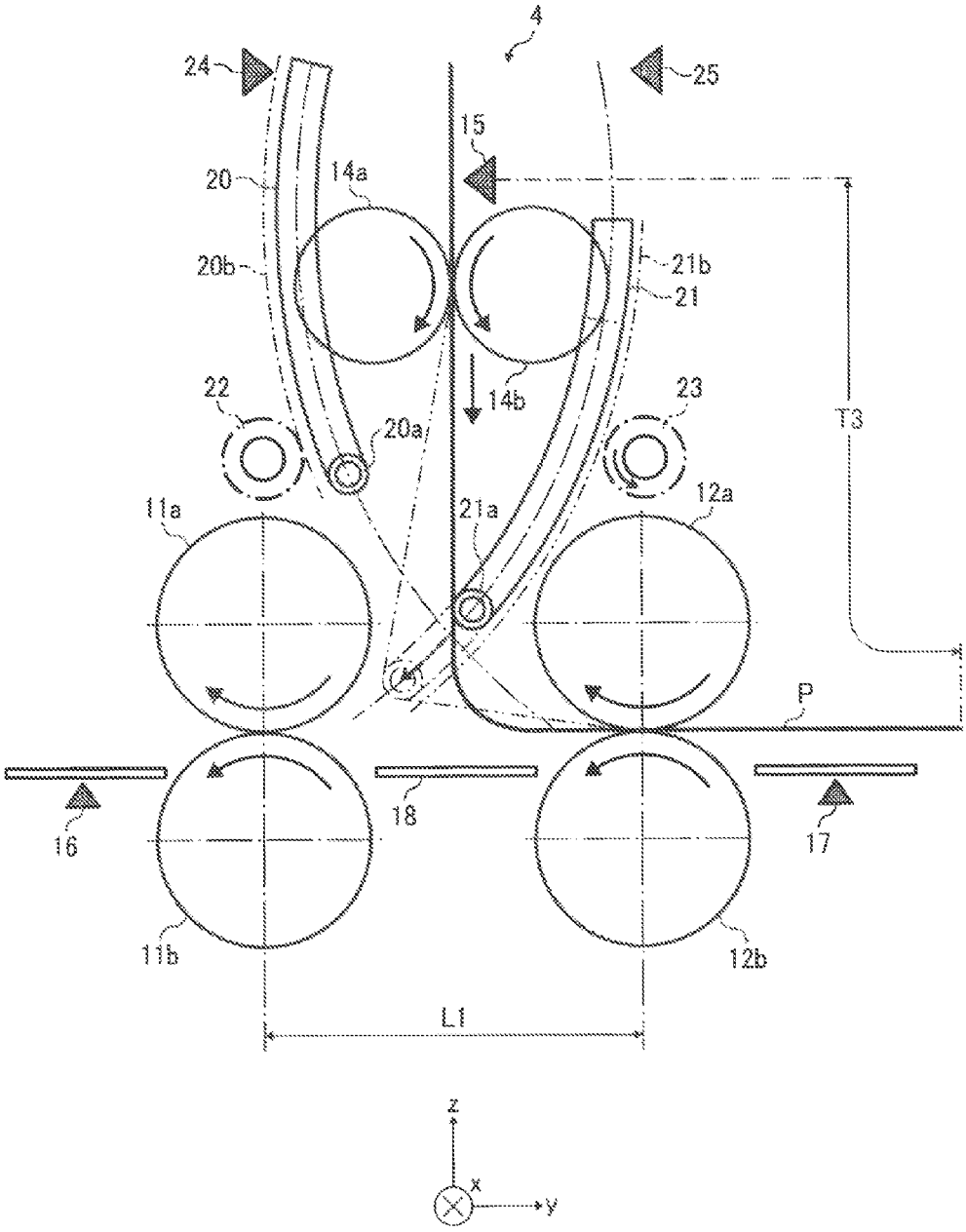
FIG. 3 is an enlarged side view of the relevant parts of the accordion folding mechanism shown in FIG. 1, depicting the middle of a process for feeding a sheet to a roller pair by a left deflection guide.

The outline of accordion fold is explained with reference to FIGS. 2 to 5. The sheet P introduced to the paper folding apparatus 1 online or offline is guided to the accordion folding mechanism 4. When the front end of the sheet P is detected by the front-end detection sensor 15, the folding controller 100 normally rotates the carrier motor and the folding motor, to rotate the pair of carrier rollers 14 and the pairs of folding rollers 11 and 12 in a direction or arrow in FIG. 2, so that the right deflection guide 20 is moved close to the right pair of folding rollers 12, with the timing adjusted. The sheet P is then guided toward the right as shown in FIG. 2, enters into the nip of the right pair of folding rollers 12 and is carried. After the sheet P enters into the nip of the right pair of folding rollers 12, the folding controller 100 returns the right deflection guide 20 to the standby position. When the right-folding-width detection sensor 17 detects the front end of the sheet P, the folding controller 100 stops driving of the folding motor after a certain period of time, to stop the rotation of the pairs of folding rollers 11 and 12. As shown in FIG. 3, the folding controller 100 starts to move the left deflection guide 21, and reversely rotates the folding motor. The left deflection guide 21 then abuts against the middle of the sheet P, and as shown in FIG. 4, to move the sheet close to the left pair of folding rollers 11, with the abutted point designated as an apex. Because the sheet P is carried downward by the pair of carrier rollers 14 and, at the same time, leftward by the pairs of folding rollers 11 and 12, the apex of the sheet where the front end of the left deflection guide 21 abuts against enters into the nip of the left pair of folding rollers 11, so that a first fold of the accordion fold is formed, with this portion designated as a fold, that is, a first fold. That is, the sheet P is folded back.

Figure 5:
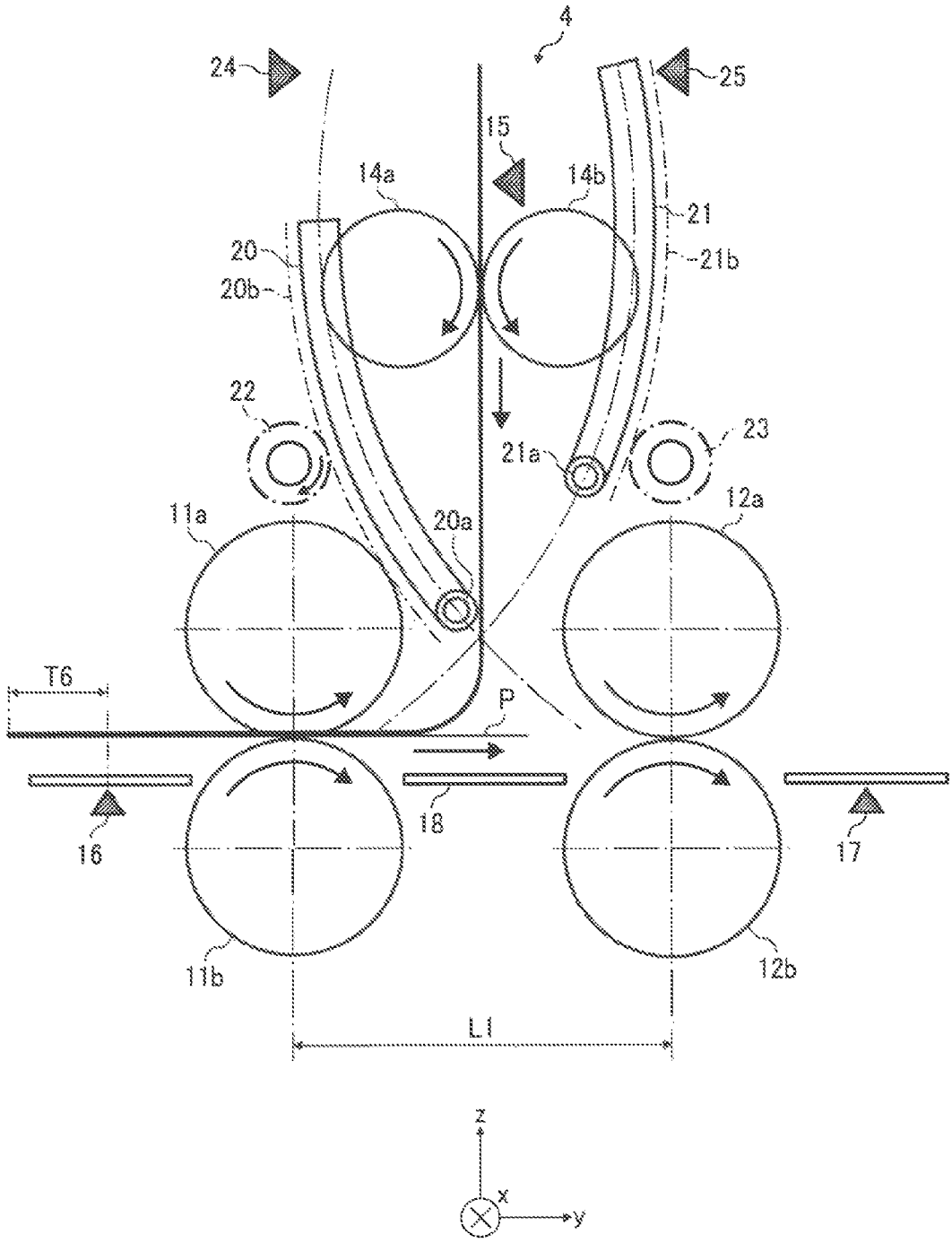
FIG. 5 is an enlarged side view of the relevant parts of the accordion folding mechanism shown in FIG. 1, depicting the middle of a process in which the right deflection guide moves toward the roller pair for feeding the sheet to a roller pair again.

The reverse rotation of the folding motor is then stopped at predetermined timing (T6) after the left-folding-width detection sensor 16 detects the first fold. The left deflection guide 21 is returned to the standby position immediately after the first fold enters into the nip of the pair of folding rollers 11, as in the case that the front end of the sheet P is guided to the right pair of folding rollers 12. After the folding motor is stopped, the folding motor is normally rotated, thereby rotating the pairs of folding rollers 11 and 12, as shown in FIG. 5, in a right feed direction, so that the front end of the sheet is fed toward the roller pair 12*a*. Simultaneously, the movement of the right deflection guide 20 is started, so that the roller 20*a* of the right pair of folding rollers 12 abuts against the middle of the sheet P, to move the sheet close to the right pair of folding rollers 12, with the abutted portion designated as an apex. Because the sheet P is carried downward by the pair of carrier rollers 14 and, at the same time, rightward by the pairs of folding rollers 11 and 12, the apex of the sheet where the roller 20*a* of the right deflection guide 20 abuts against enters into the nip of the right pair of folding rollers 12, so that a second fold of the accordion fold is formed, with this portion designated as a fold, that is, a second fold.

Subsequently, when folds of a third fold onward are required, the third fold onward are sequentially formed by repetition of the movement of one of the left and right deflection guides and normal or reverse rotation of the folding motor, as in the above procedure.

The size of each fold from the first fold of accordion fold, that is, the folding size is determined, in the case of the first fold, by elapsed time T4, as shown in FIG. 2, since detection of the front end of the sheet P by the right-folding-width detection sensor 17 until the pairs of folding rollers 11 and 12 being stopped. Likewise, in the case of the second fold, the folding size is determined by elapsed time T6, as shown in FIG. 5, since detection of the first fold by the left-folding-width detection sensor 16. In the case of the third fold onward, the folding size is determined by the time T4 or T6 alternately corresponding to the number of the fold, matched with the movement of the left or right deflection guide and repetition of normal rotation and reverse rotation of the folding motor.

The folding width of the first fold can be also determined based on elapsed time T3 since detection of the front end of the sheet P by a front-end detection sensor 14, as shown in FIG. 3. As another determination method of the folding width of the second fold onward, after the first fold is formed, the folding roller is stopped, and the folding roller is stopped after a predetermined time from a moment when rotation of the folding roller is started again in a rightward direction. The predetermined time can be used for managing the folding width. In any case, the folding width (y direction) is determined by managing the normal and reverse rotation amount of the folding roller.

In the explanation above, the front end of the sheet P is guided rightward. In the case of online, when the sheet P is introduced into the paper folding apparatus 1, a printing face is normally formed on the upper face thereof. Therefore, the first fold is formed as valley fold. However, the front end of the sheet P can be guided leftward by moving the left deflection guide 21 first, to fold the first fold as mountain fold.

Figure 6:
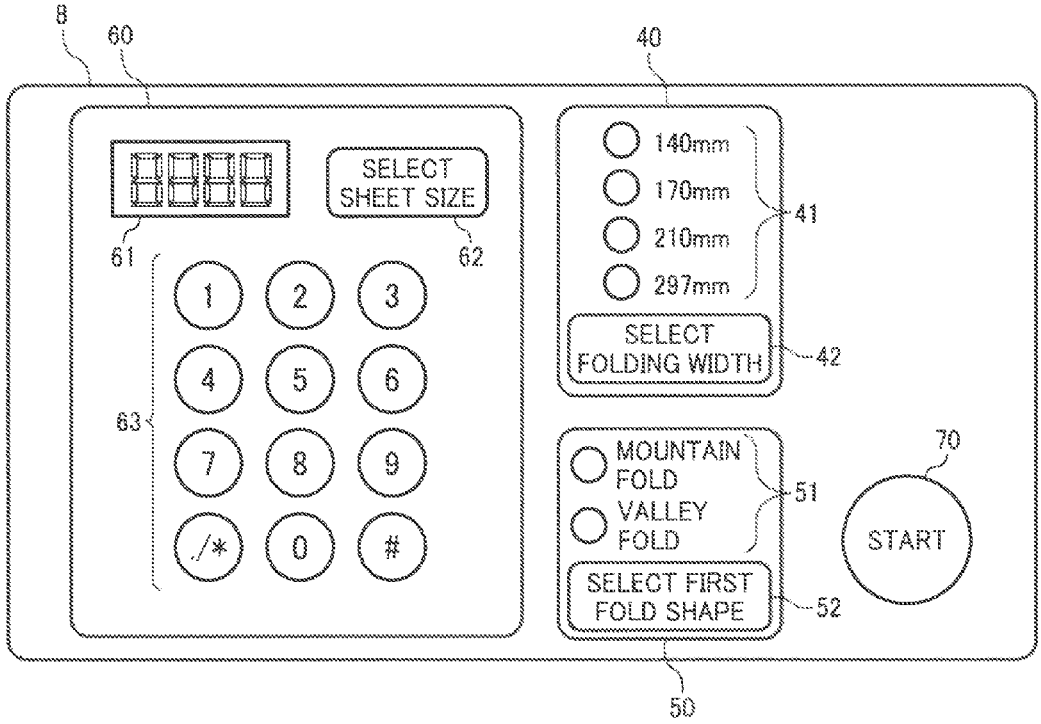
FIG. 6 is an enlarged plan view of an operation display board shown in FIG. 1.

FIG. 6 is a schematic diagram of the operation display board 8 provided in the paper folding apparatus 1. A folding-size setting section 40 on the operation display board 8 includes a folding-width selection button 42 for selecting the folding size and a folding size display 41 for displaying the currently selected folding size. The folding size display 41 makes it possible to confirm the currently selected folding size by lighting up one of light emitting diodes (LEDs) provided at the side of folding size description, which can be selected. Every time the folding-width selection button 42 is pressed, the LED to be lighted up is changed over.

A folding-type setting section 50 is provided below the folding-size setting section 40, and includes a first-fold shape selection button 52 for selecting the folding shape of the first fold, and a folding type display 51. The folding type display 51 makes it possible to confirm the currently selected folding type by lighting up either one of LEDs indicating whether the first fold is to be mountain fold or valley fold, which is changed over by pressing the first-fold shape selection button 52.

A sheet-size setting section 60 includes a sheet-size selection button 62, ten keys 63, and a sheet size display 61. When the sheet-size selection button 62 is pressed, standard sizes A0, A1, A2, and the like are sequentially displayed on the sheet size display 61. The length of the sheet to be inserted can be directly input in a unit of millimeter by the ten keys 63.

A setting unit equivalent to the setting units of the sheet size, folding type, and folding size on the operation display board 8 of the paper folding apparatus 1, and a transfer instruction key are provided on the operation display board 220 of the copying machine 200. When the user operates the transfer instruction key, the sheet size, folding type, and folding size set on the operation display board 220 of the copying machine 200 are transferred from the copying machine 200 to the paper folding apparatus 1, thereby setting the sheet size, folding type, and folding size on the paper folding apparatus 1. Accordingly, at the time of an online operation, necessary setting need not be performed both on the operation display boards 220 and 8 of the copying machine 200 and the paper folding apparatus 1, but can be done only by the copying machine 200. Necessary setting can be performed by one operation unit, thereby facilitating the convenience of operation.

Figure 8:
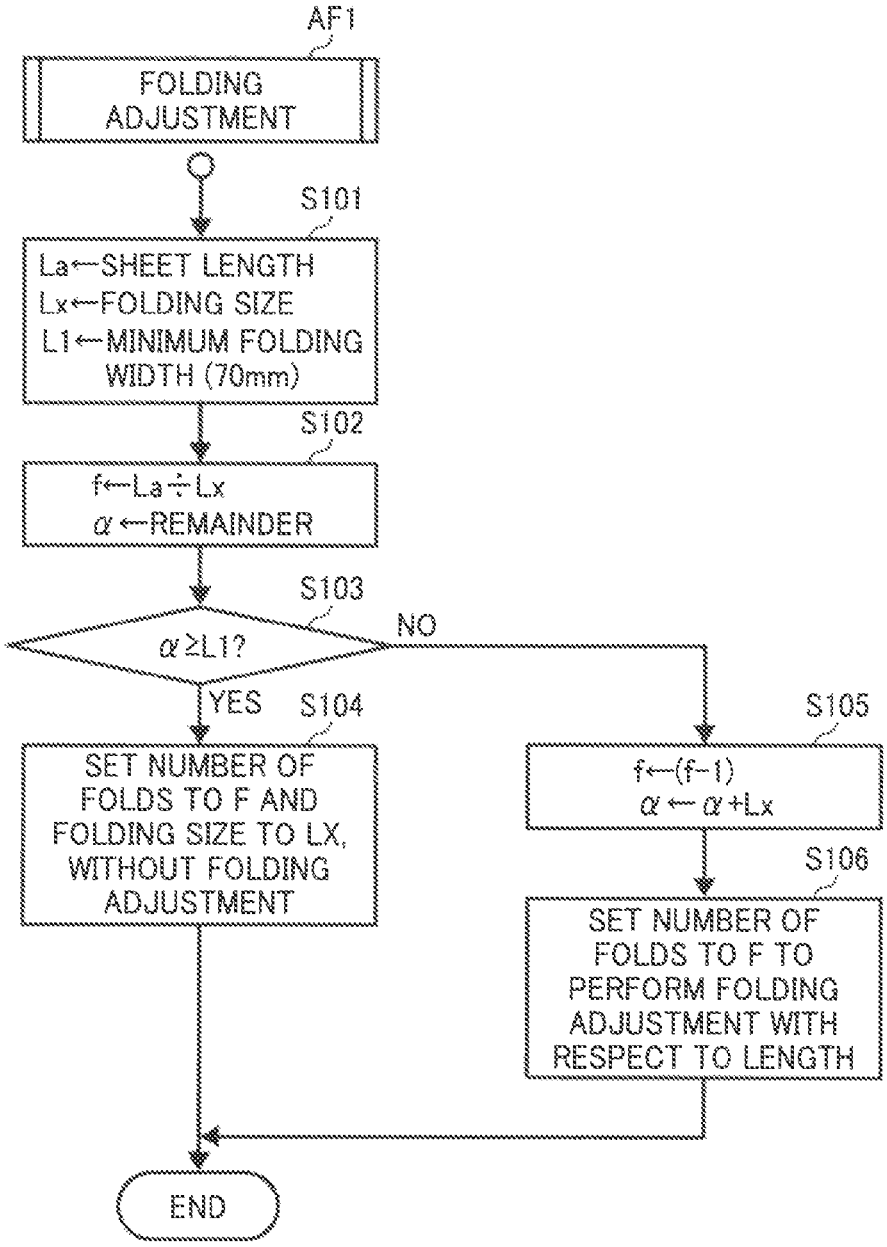
FIG. 8 is a flowchart of an outline of setup control in a paper folding mode by a folding controller shown in FIG. 7.

FIG. 7 is a schematic diagram for explaining a configuration associated with paper folding of the paper folding apparatus 1, and FIG. 8 is a flowchart of a process for setting a folding control mode by the folding controller 100 in the paper folding apparatus 1. Explanations below refer to FIG. 8. The user first sets the folding size by the folding-size setting section 40 on the operation display board 8 of the paper folding apparatus 1, and then sets the folding type by the folding-type setting section 50. As an example, the folding size is set to 210 millimeters, and the folding type is set to mountain fold. When the copying machine 200 performs a copying operation corresponding to the user's operation, the copied sheet is supplied to the paper folding apparatus 1, and sheet size (sub scanning length) data is notified to the paper folding apparatus 1 from the copying machine 200. The folding controller 100 determines a sheet length La and a folding size Lx, which are operational parameters, and sets the minimum folding width L1 of the paper folding apparatus 1 as a distance between nips (in the first embodiment, 70 millimeters) of the pairs of folding rollers 11 and 12 shown in FIG. 2. The folding controller 100 then divides the sheet length La by the folding size Lx, designates an obtained integer as f and a remainder as α (Step S102), and compares α with the minimum folding width L1 (Step S103).

When α is equal to or larger than L1, the folding controller 100 sets the number of folds to f and the folding size to Lx to perform folding (Step S104). In this case, because α is smaller than the folding size Lx and equal to or larger than the minimum folding width L1, folding adjustment is not applied.

Figure 10A:
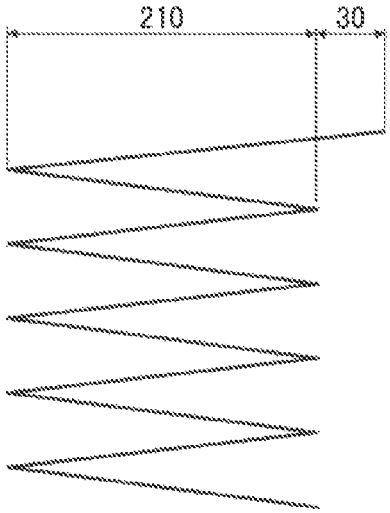
FIGS. 10A to 10C are side views of the folded sheet, where
Figure 10B:
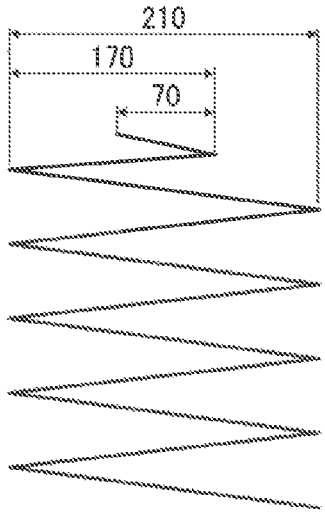
Figure 10C:
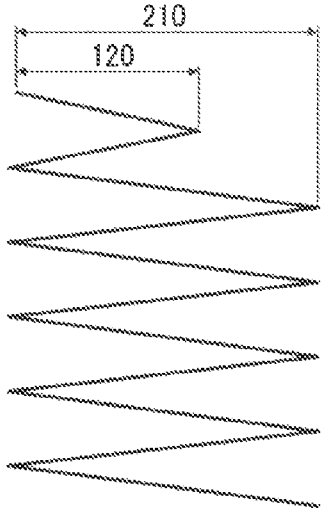

When α<L1, the folding controller 100 decreases f by 1, sets α to α+Lx (Step S105), and performs folding adjustment as shown in FIG. 10B or 10C with respect to α+Lx (Step S106). That is, the integer f obtained by dividing the sheet length La by the folding size Lx is decreased by 1, a length Lx corresponding to integer 1 is added to α, to set the remaining length α+Lx to a value equal to or larger than the minimum folding width L1, and the remaining length α+Lx is folded back at a position where both folds become equal to or larger than the minimum folding width L1.

For example, when the sub scanning length notified from the copying machine 200 is 2100 millimeters, the folding controller 100 in the paper folding apparatus 1 divides the sub scanning length of 2100 millimeters of the sheet by the folding size 210 millimeters (Lx). In this case, because 2100 can be divided by 10 (f=10) without producing any remainder, the folding controller 100 does not perform any adjustment, to fold all the folds with 210 millimeters to finish folding as a folded bundle of ten folds. However, when the notified sub scanning length is 2130 millimeters, if 2130 millimeters is divided by 210 millimeters, a remainder of 30 millimeters is produced.

There are some factors for determining the minimum sheet width that can be folded by the paper folding apparatus, depending on the mechanical configuration of the paper folding apparatus. In the configuration example of the paper folding apparatus 1 according to the first embodiment, the minimum sheet width is determined by L1, which is the distance between nips of the pairs of folding rollers 11 and 12 shown in FIG. 2. L1 is set to 70 millimeters herein, that is, the minimum folding width by the paper folding apparatus 1 is 70 millimeters.

As in the above example, if there is the remainder (α) of 30 millimeters as a result, it is smaller than the minimum folding width, 70 millimeters (L1), and therefore the last fold cannot be folded. Accordingly, the finished length of the last fold becomes 210 mm+30 mm=240 mm (α+Lx), which means that the sheet protrudes from the desired finished size of 210 millimeters, as shown in FIG. 10A. If the sheet having the sub scanning length of 2130 millimeters is folded by the folding size of 210 millimeters to have ten faces, there is a remainder of 30 millimeters. When this sheet is folded to have nine faces (f−1), 2130 mm+210 mm=9 folds+remainder of 240 millimeters (α+Lx), and the remainder of 240 millimeters is folded once with a length 170 millimeters, which is a result of subtraction of the minimum folding width of 70 millimeters from 240 millimeters, to obtain the last fold with a width of 70 millimeters. Therefore, as shown in FIG. 10B, there is no protrusion from the finished size of 210 millimeters. Alternatively, 240 millimeters can be simply divided into two, to fold the sheet as shown in FIG. 10C.

In the first embodiment, the sheet size to be inserted into the paper folding apparatus 1 from the copying machine 200 is notified beforehand from the copying machine 200 to the paper folding apparatus 1. The paper folding apparatus 1 compares the sheet size with the set folding size, and when determining that the specified finishing state cannot be obtained, adjusts and changes the set folding size for some faces at the rear end of the sheet. Accordingly, a certain finishing state can be achieved even in the case of folding of a sheet of an irregular size.

The folding controller 100 according to a second embodiment of the present invention measures the sub scanning length of the sheet inserted into the paper folding apparatus 1, without being notified from the copying machine 200. As a sheet-size measuring unit in this case, the sheet-insertion detection sensor 31 and the sheet-length detection sensor 32 can perform the function. However, in the second embodiment, the sheet-length detection sensor 32 detects the sheet length. Hardware and other functions in the second embodiment are the same as those in the first embodiment. In the second embodiment, because the paper folding apparatus 1 itself measures the sheet size, the sheet size need not be notified from the copying machine 200, thereby reducing notification information from the copying machine 200 to the paper folding apparatus 1, to enable simplification of the system.

In the first and the second embodiments, the paper folding apparatus 1 includes the manual feed table 7 for directly inserting a copy that has been made by the copying machine 200 previously but has not gone through the paper folding apparatus 1, or a copy obtained by another copying machine into the paper folding apparatus 1, and the operation display board 8 enabling to set the size of the sheet to be inserted. The paper folding apparatus 1 compares the set folding size with the set sheet size, and adjusts the set folding size for some faces at the rear end of the sheet. That is, the paper folding apparatus 1 alone can fold the sheet in a desired folding size. When the specified finishing state cannot be obtained, the paper folding apparatus 1 adjusts and changes the set folding size for some faces at the rear end of the sheet. Accordingly, a certain finishing state can be obtained even in the case of folding of a sheet having an irregular size.

In the second embodiment, the sheet-length detection sensor 32 measures the length of the sheet supplied online, that is, the sheet copied by the copying machine 200 and fed to the paper folding apparatus 1, and a manually fed sheet supplied offline, that is, the sheet placed on the manual feed table 7, inserted into the manual-feed sheet-insertion port, and drawn into by the roller pair 13. Therefore, a sheet-length measurement error due to the sensor itself or due to an installation error of the sensor is not different between online and offline, thereby stabilizing the folding size. A labor of the user to measure the size of the sheet whose size is unknown and input from the operation display board 8 is not required.

When folding is actually performed by the paper folding apparatus, the folding size may not be the same as the set Lx, due to paper quality, paper thickness, and a difference of a control mechanism. For example, in the case of the sheet length being 2130 millimeters and the folding size being 210 millimeters as in the above embodiments, the remaining length α is calculated as 30 millimeters. However, if an error of +1 mm in the actually folded size has occurred for each face due to a mechanical difference, the actual remaining length α becomes 20 millimeters. Therefore, in a third embodiment of the present invention, a remaining length of the sheet to be folded is monitored, and when the remaining length becomes smaller than a set value, it is determined whether adjustment of the folding size is required with respect to the remaining length.

Figure 11:
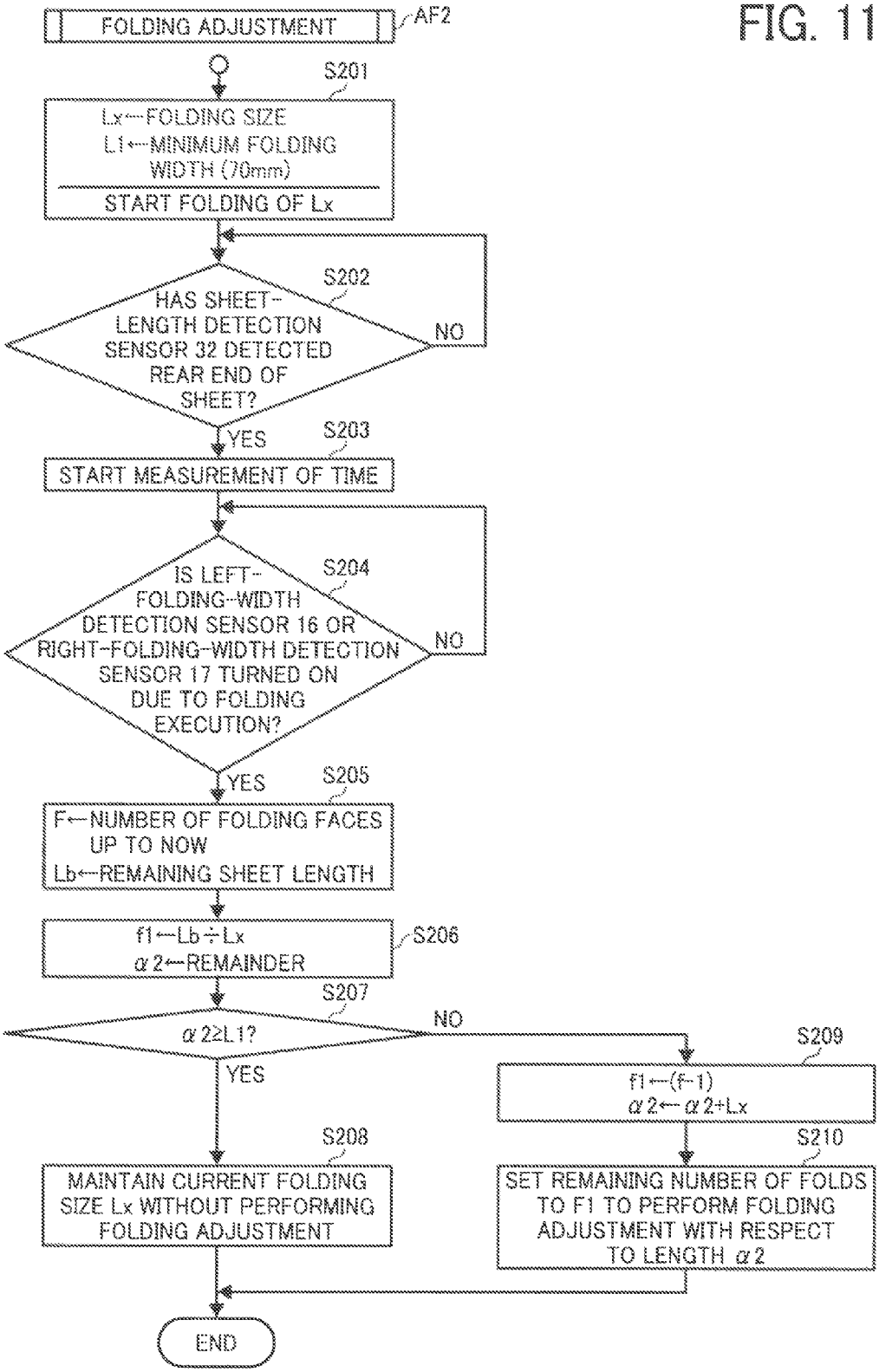
FIG. 11 is a flowchart of an outline of setting control of a paper folding mode by a folding controller according to a third embodiment of the present invention.

FIG. 11 is a flowchart of a process for setting a folding control mode by the folding controller 100 according to the third embodiment. The user first sets the folding size by the folding-size setting section 40 on the operation display board 8 of the paper folding apparatus 1, and the folding type by the folding-type setting section 50. When the copying machine 200 performs the copy operation according to the user's operation, the copied sheet is supplied to the paper folding apparatus 1. The folding controller 100 sets the distance between the pairs of folding rollers 11 and 12 and the folding size input by the folding-size setting section 40 as the minimum folding width L1 and the folding size Lx, respectively, which are the operational parameters, to start folding, designating the folding size Lx as a target value (Step S201).

After the sheet enters into the paper folding apparatus 1 through the connecting part 2, and the sheet-length detection sensor 32 becomes a paper detection (ON) state, the folding controller 100 monitors switching to a paper non-detection (OFF) state. Until then, the folding controller 100 performs folding, by setting the folding size Lx as the target value.

The folding controller 100 starts to measure the time (measurement of a shift amount of the sheet) from the moment when the sheet-length detection sensor 32 is turned OFF (Steps S202 and S203). After starting the measurement, and when the left-folding-width detection sensor 16 or the right-folding-width detection sensor 17 is turned ON, the folding controller 100 sets the number of folds until then to the parameter f, and determines the remaining sheet length Lb, which has not been folded yet (204, 205). For example, when the left-folding-width detection sensor 16 is turned ON, the remaining sheet length Lb becomes a value obtained by subtracting a distance (sheet shift amount) corresponding to the time since turning OFF of the sheet-length detection sensor 32 until start of measurement from the distance L3 between the sheet-length detection sensor 32 and the left-folding-width detection sensor 16 shown in FIG. 1.

The folding controller 100 then calculates a quotient f1 obtained by dividing Lb by the folding size Lx and a remainder $\alpha$2 (Step S206), and compares $\alpha$2 with the minimum folding width L1 (Step S207). When $\alpha$2 is equal to or larger than L1, the folding controller 100 folds the remaining length Lb with the current folding size Lx without performing folding adjustment (Step S208). When $\alpha$2 is smaller than L1, the folding controller 100 folds the unfolded remaining sheet length $\alpha$2 with the current folding size Lx for the number of folds (f1−1), and performs the same adjustment as in the first embodiment with respect to the remaining length ($\alpha$2+Lx) (Step S210). In the case of folding adjustment AF2, the length folded after the sheet-length detection sensor 32 has detected passage of the rear end of the sheet until the left-folding-width detection sensor 16 or the right-folding-width detection sensor 17 detects the sheet is not managed, and thereafter, it is determined whether folding adjustment is required for the remaining length to perform adjustment when required. Therefore, as the length of the sheet becomes long, an error decreases as compared with folding adjustment AF1 in the first embodiment. A base point for measurement of the remaining length can be switching from ON to OFF of the sheet-insertion detection sensor 31 (online) or 30 (offline), instead of switching from ON to OFF of the sheet-length detection sensor 32, or can be after a predetermined time since such switching (after the sheet has moved for a predetermined amount). The timing needs only to be the timing capable of measuring the remaining length Lb, at which calculation at Steps S209 and S210 is possible. The hardware and other functions in the third embodiment are the same as those in the first embodiment, or can be the same as those in the second embodiment.

The folding controller 100 according to the third embodiment determines the number of folds for the unfolded remaining sheet length Lb according to the set folding type and which of the left-folding-width detection sensor 16 and the right-folding-width detection sensor 17 is turned ON, when the remaining sheet length unfolded after the rear end of the sheet has been detected is determined. For example, when the folding type is set to mountain fold, and the left-folding-width detection sensor 16 is turned ON when the unfolded remaining sheet length is determined, the number of folds folded until that time is always an even number.

Figure 9A:
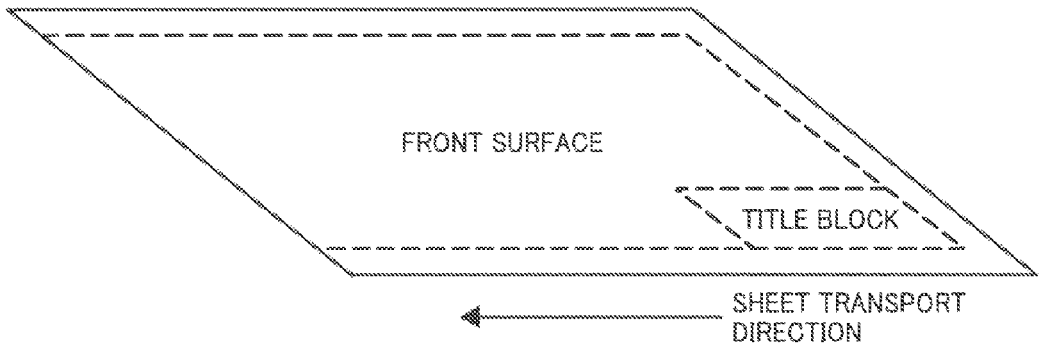
FIGS. 9A to 9C are perspective views of a sheet to be folded, where
Figure 9B:
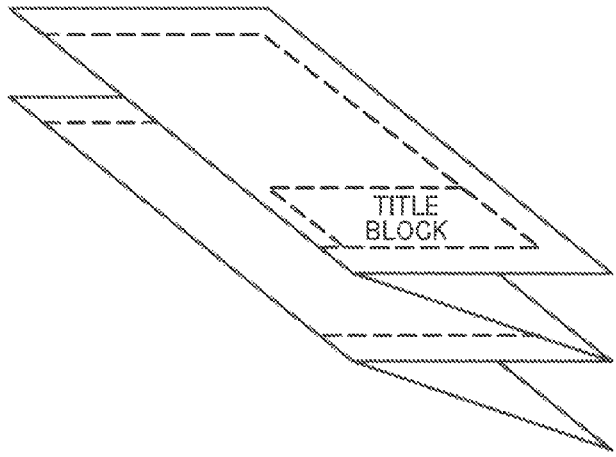
Figure 9C:
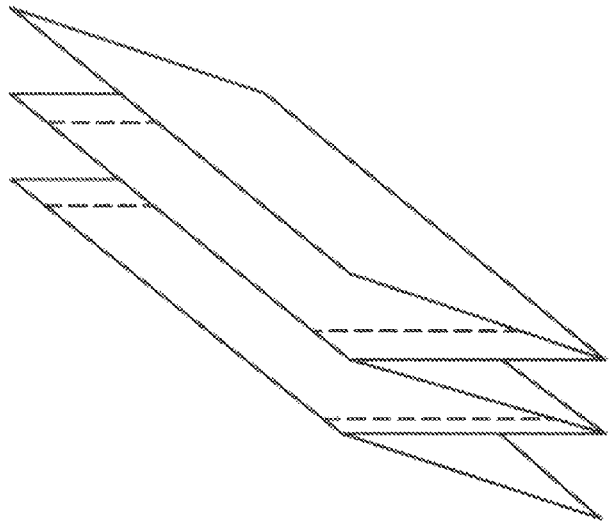
Figure 12:
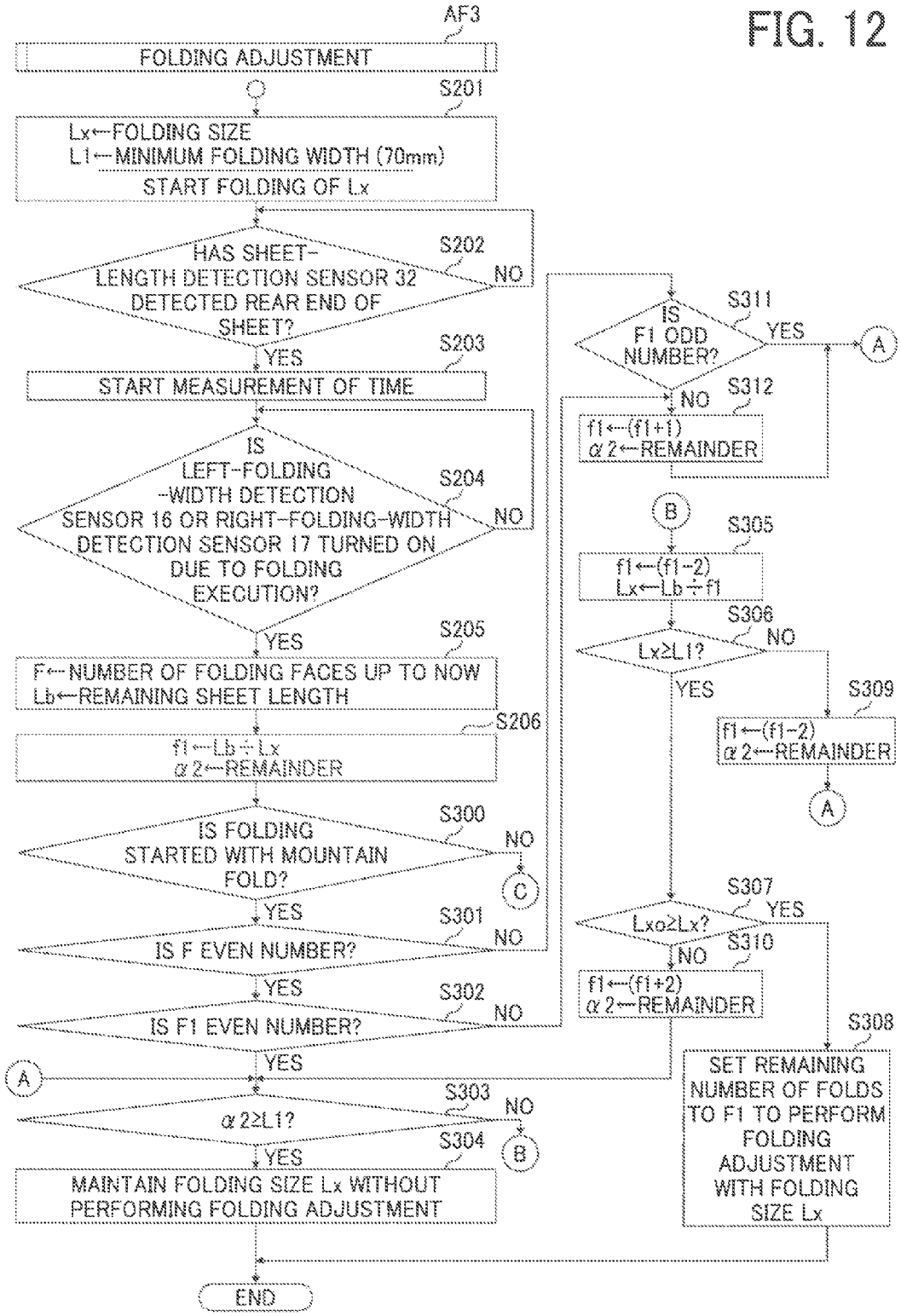
FIG. 12 is a flowchart of a part of an outline of a setup control in a paper folding mode by a folding controller according to a fourth embodiment of the present invention.

As described in the related technology, when a drawing is folded, if folding is started with mountain fold, as shown in FIG. 9B, it is desired to finish folding with an even number of folded faces so that the title block is on the outside. If folding is started with valley fold, it is desired to finish folding with an odd number of folded faces so that the title block is on the outside. Therefore, in the folding controller 100 according to a fourth embodiment of the present invention, when folding is started with mountain fold, if the number of already folded faces (Step S205) is an even number, as shown in FIG. 12, a folding control parameter is adjusted so that the unfolded remaining sheet length Lb is folded with even faces (Steps S301, S302, S311, and S312). That is, the number of folds f1 for the remaining sheet length Lb and the folding size Lx are adjusted so that the finish is an even number as shown in FIG. 9B. If the number of already folded faces f (Step S205) is an odd number, the folding control parameter is adjusted so that the unfolded remaining sheet length Lb is folded with odd faces.

Figure 13:
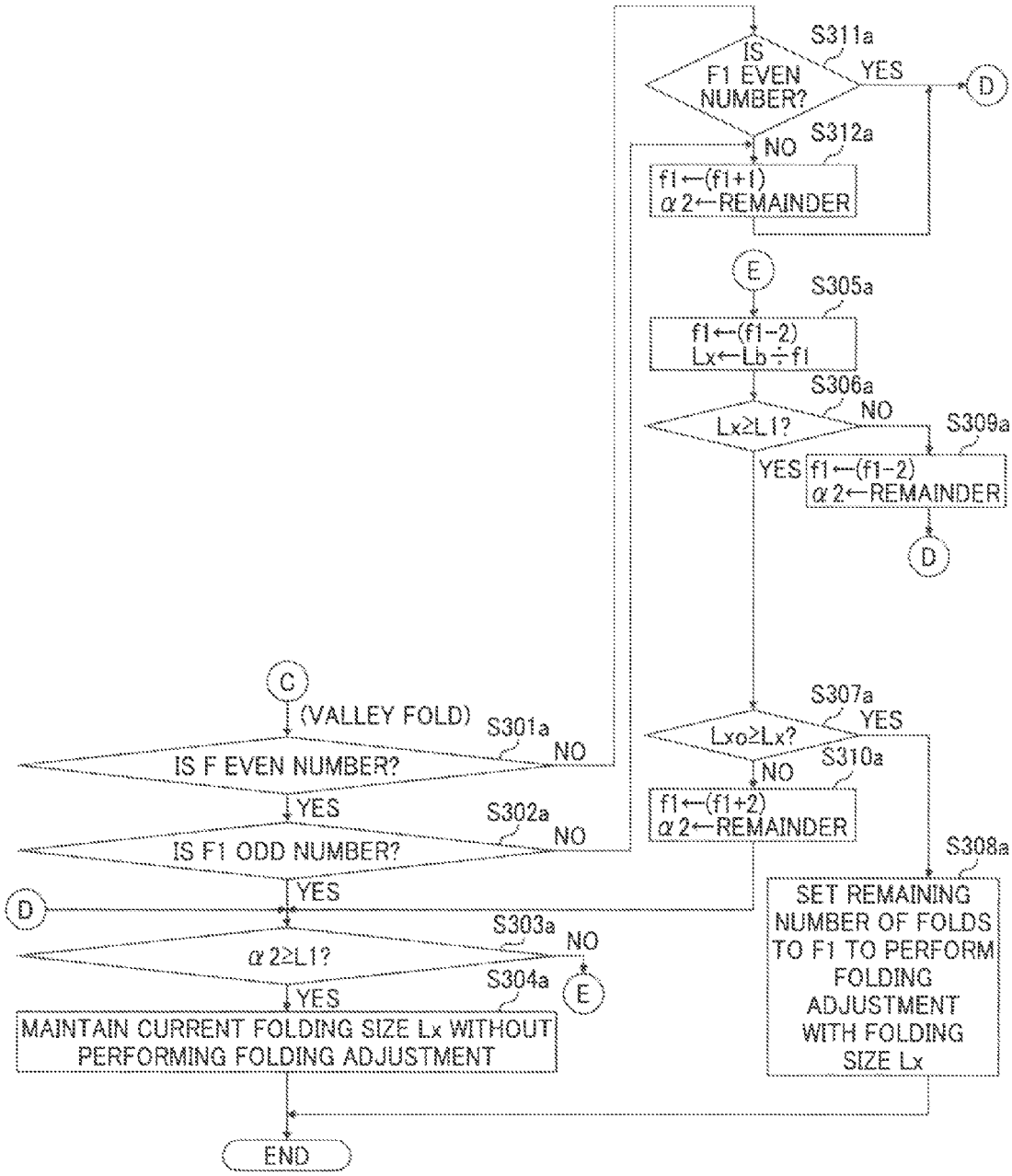
FIG. 13 is a flowchart of other parts of the outline of the setup control in the paper folding mode by the folding controller according to the fourth embodiment.

When folding is started from valley fold, if the number of already folded faces f (Step S205) is an even number, as shown in FIG. 13, the folding control parameter is adjusted so that the unfolded remaining sheet length Lb is folded with odd faces (Steps S301*a*, S302*a*, S311*a*, and S312*a*). That is, the number of folds f1 for the remaining sheet length Lb and the folding size Lx are adjusted so that the finish is an odd number. If the number of already folded faces f (Step S205) is an odd number, the folding control parameter is adjusted so that the unfolded remaining sheet length Lb is folded with odd faces.

In the fourth embodiment, when mountain fold is set by the operation of the first-fold shape selection button 52 in the folding-type setting section 50, if the number of already folded faces f (Step S205) is an even number, the number of folds f1 for the remaining sheet length Lb is an even number, and the folding width $\alpha$2 of the last fold is equal to or larger than the minimum folding width L1, folding for the number of folds f1 is performed (Step S304). However, if $\alpha$2 is smaller than the minimum folding width L1, the number of folds f1 is reduced by 2 to calculate the folding size Lx in that case (Step S305). When the calculated folding size Lx is equal to or larger than the minimum folding width L1 and equal to or smaller than the folding size first set by the user (Lxo: Step S201 in FIG. 12), folding adjustment with the calculated folding size Lx is performed (Steps S306 to S308). That is, the unfolded remaining length Lb is divided by two or four by the folding adjustment (Steps S305 to S308). A result of division of Lb by an even number is compared with the minimum folding width L1 and the set folding size Lx, to select bisection or quadrisection (or hexasection) so that there is no inconvenience. When the number of folds f1 for the remaining sheet length Lb is an odd number, the number of folds f1 for the remaining sheet length Lb is increased by 1 to obtain an even number, and a remainder α2 (can be a negative value) in a case that folds other than the last fold are set to the folding size Lx (=Lxo) is calculated (Step S312), to execute Step S303 onward.

When a calculated value Lx in folding adjustment (Step S305) is smaller than the minimum folding width L1, the number of folds f1 is reset to be reduced by 2, to calculate the remainder α2 (can be a negative value) in the case that folds other than the last fold are set to the folding size Lx (=Lxo) (Step S309), thereby executing Step S303 onward. When the calculated value Lx in folding adjustment (Step S305) exceeds the folding size Lx (=Lxo) first set by the user, the number of folds f1 is reset to be increased by 2, to calculate the remainder α2 (can be a negative value) in the case that folds other than the last fold are set to the folding size Lx (=Lxo) (Step S309), thereby executing Step S303 onward.

When the number of already folded faces f (Step S205) is an odd number, the folding control parameter is adjusted so that the unfolded remaining sheet length Lb is folded with odd faces (Steps S301, S302, S311, and S312). That is, when the number of folds f1 for the remaining sheet length Lb is an odd number, and the folding width α2 of the last fold is equal to or larger than the minimum folding width L1, folding for the number of folds f1 is performed (Steps S303 and S304). However, if α2 is smaller than the minimum folding width L1, the number of folds f1 is increased by 2 to calculate the folding size Lx in that case (Step S305). When the calculated folding size Lx is equal to or larger than the minimum folding width L1 and equal to or smaller than the folding size Lxo first set by the user, folding adjustment with the calculated folding size Lx is performed (Steps S306 to S308). When the number of folds f1 for the remaining sheet length Lb is an even number, the number of folds f1 for the remaining sheet length Lb is increased by 1 to obtain an odd number, and a remainder α2 (can be a negative value) in the case that folds other than the last fold are set to the folding size Lx (=Lxo) is calculated (Step S312), to execute Step S303 onward.

When valley fold is set by the operation of the first-fold shape selection button 52 in the folding-type setting section 50, if the number of already folded faces f (Step S205) is an even number according to the flow shown in FIG. 13, the folding control parameter is adjusted so that the unfolded remaining sheet length Lb is folded with odd faces (Steps S301*a*, S302*a*, S311*a*, and S312*a*). That is, the number of folds f1 for the remaining sheet length Lb and the folding size Lx are adjusted so that the finish is an odd number. If the number of already folded faces f (Step S205) is an odd number, the folding control parameter is adjusted so that the unfolded remaining sheet length Lb is folded with odd faces. Reference numerals of each step shown in FIG. 13 are denoted by adding "a" to the numeral of a corresponding processing step when mountain fold shown in FIG. 12 is set.

When mountain fold is set, if f1 is an even number, f1 is also set to an even number, and if f1 is an odd number, f1 is also set to an odd number by executing Steps S301 to S312 in FIG. 12, so that the last fold becomes an even number. When valley fold is set, if f1 is an even number, f1 is set to an odd number, and if f1 is an odd number, f1 is set to an even number by executing Steps S301*a* to S312*a* in FIG. 13, so that the last fold becomes an odd number. In either case, the title block of the drawing on the surface of the sheet (image) appears on the outside and last fold.

Folding adjustment in the fourth embodiment (Steps S305 to S308 and S305*a* to S308*a*) is such that the unfolded remaining length Lb is divided by two or four. A result of division of Lb by an even number is compared with the minimum folding width L1 and the set folding size Lx, to select bisection or quadrisection (or hexasection) so that there is no inconvenience. The hardware and other functions in the fourth embodiment are the same as those in the first embodiment, or can be the same as those in the second embodiment.

According to the fourth embodiment, when the unfolded remaining sheet length Lb is confirmed, the number of folds for the remaining sheet length Lb is adjusted according to the selected folding type and the number of already folded faces f. Therefore, a desired finish can be obtained so that the title block of the drawing always appears on the outside and last fold of the folded sheet.

As described above, according to one aspect of the present invention, the sheet size (La, Lx·f+Lb) is compared with the folding size (Lx), and when the finish size is protrudes from the folding size, the folding size of some faces at the rear end of the sheet is automatically adjusted, so that sheets of any size can be folded in a uniform finish size, and folding adjustment can be performed accurately. The sheet can be folded in a desired finishing state, such that the title block of the drawing always appears on the outside.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper folding apparatus comprising:

an accordion folding mechanism that folds a sheet fed from an image forming apparatus in an accordion shape by folding a mountain fold and a valley fold in a direction perpendicular to a sheet conveying direction;

a size setting unit that sets a folding size of the mountain fold and the valley fold; and a size adjusting unit that compares a size of the sheet fed from the image forming apparatus with the folding size, and adjusts a folding width of a predetermined number of folds at a trailing end of the sheet to be equal to or smaller than the folding size set by the size setting unit, wherein the size adjusting unit calculates number of folds for folding the sheet with the folding size and the folding width of a last fold, which is a residual width, when the folding width of the last fold is smaller than a predetermined minimum folding width, subtracts one from the number of folds to increase the folding width of the last fold to a value larger than the minimum folding width, and sets the folding width of a last-but-one fold to a value obtained by subtracting an increased amount of the folding width of the last fold from the folding size.

2. The paper folding apparatus according to claim 1, wherein the size adjusting unit increases the folding width of the last fold to the minimum folding width.

3. The paper folding apparatus according to claim 1, wherein the size adjusting unit sets the folding width of the last fold and the folding width of the last-but-one fold to a half of a sum of a calculated folding width and the folding size.

4. A paper folding apparatus comprising:

an accordion folding mechanism that folds a sheet fed from an image forming apparatus in an accordion shape by folding a mountain fold and a valley fold in a direction perpendicular to a sheet conveying direction;

a size setting unit that sets a folding size of the mountain fold and the valley fold;

a measuring unit that measures a remaining sheet length that is remained unfolded; and a size adjusting unit that compares the remaining sheet length with the folding size, and adjusts folding width of a predetermined number of folds at a trailing end of the sheet to be equal to or smaller than the folding size set by the size setting unit wherein the size adjusting unit calculates number of folds for folding the remaining sheet length with the folding size and the folding width of a last fold, which is a residual width, and when the folding width of the last fold is smaller than a predetermined minimum folding width, subtracts one from the number of folds to increase the folding width of the last fold to a value larger than the minimum folding width, and sets the folding width of a last-but-one fold to a value obtained by subtracting an increased amount of the folding width of the last fold from the folding size.

5. The paper folding apparatus according to claim 4, wherein the size adjusting unit increases the folding width of the last fold to the minimum folding width.

6. The paper folding apparatus according to claim 4, wherein the size adjusting unit sets the folding width of the last fold and the folding width of the last-but-one fold to a half of a sum of a calculated folding width and the folding size.

7. The paper folding apparatus according to claim 4, further comprising a conveying unit that conveys the sheet fed from an image forming apparatus to the accordion folding mechanism.

8. The paper folding apparatus according to claim 4, further comprising:

a manual feed port for manually feeding a sheet;

a manual feed table that supports the sheet inserted into the manual feed port; and a conveying unit that conveys the sheet inserted into the manual feed port to the accordion folding mechanism.

9. A paper folding apparatus comprising:

an accordion folding mechanism that folds a sheet fed from an image forming apparatus in an accordion shape by folding a mountain fold and a valley fold in a direction perpendicular to a sheet conveying direction;

a size setting unit that sets a folding size of the mountain fold and the valley fold;

a measuring unit that measures a remaining sheet length that is remained unfolded; and a size adjusting unit that compares the remaining sheet length with the folding size, and adjusts folding width of a predetermined number of folds at a trailing end of the sheet to be equal to or smaller than the folding size set by the size setting unit, a setting unit that sets the mountain fold or the valley fold for a first fold, wherein when the mountain fold is set for the first fold, the size adjusting unit calculates remaining number of folds for folding the remaining sheet length with the folding size and a folding width of a last fold, when number of folds folded until the remaining sheet length is an even number and the remaining number of folds is an odd number, changes the remaining number of folds to an adjacent even number, and when the number of folds folded until the remaining sheet length is an odd number and the remaining number of folds is an even number, changes the remaining number of folds to an adjacent odd number, to adjust the folding width of the predetermined number of folds at the trailing end of the sheet, and when the valley fold is set for the first fold, the size adjusting unit calculates remaining number of folds for folding the remaining sheet length with the folding size and a folding width of a last fold, when number of folds folded until the remaining sheet length is an even number and the remaining number of folds is an even number, changes the remaining number of folds to an adjacent odd number, and when the number of folds folded until the remaining sheet length is an odd number and the remaining number of folds is an odd number, changes the remaining number of folds to an adjacent even number, to adjust the folding width of the predetermined number of folds at the trailing end of the sheet.

10. The paper folding apparatus according to claim 9, wherein when the folding width of the last fold is smaller than a predetermined minimum folding width, the size adjusting unit changes the remaining number of folds in a unit of two folds, to set the folding width for changed remaining number of folds to a width equal to or larger than the minimum folding width and equal to or smaller than the folding size set by the size setting unit.

11. The paper folding apparatus according to claim 9, wherein when the folding width of the last fold is smaller than a predetermined minimum folding width, the size adjusting unit changes the remaining number of folds in a unit of two folds, to set the folding width for changed remaining number of folds to a width equal to or larger than the minimum folding width and equal to or smaller than the folding size set by the size setting unit.

* * * * *